US005407025A

United States Patent [19]

Nickel

[11] Patent Number: 5,407,025

[45] Date of Patent: Apr. 18, 1995

[54] GRIPPING DEVICE FOR TIMBER

[76] Inventor: Donald C. Nickel, Capital Self Storage, E-75 Breezehill N., Ottawa, Ontario K1Y 2H6, Canada

[21] Appl. No.: 243,924

[22] Filed: May 17, 1994

Related U.S. Application Data

[63] Continuation-in-part of Ser. No. 92,053, Jul. 15, 1993, abandoned.

[51] Int. Cl.[6] ..... E06C 7/08

[52] U.S. Cl. ..... 182/92; 182/100

[58] Field of Search ..... 182/92, 134–136, 182/187, 100; 248/246

[56] References Cited

U.S. PATENT DOCUMENTS

| | | |
|---|---|---|
| 244,298 | 3/1924 | Heid . |
| 1,098,945 | 6/1914 | Frederick . |
| 1,312,399 | 8/1919 | Heywood . |
| 2,086,280 | 12/1934 | Matter . |
| 3,121,471 | 8/1962 | Soderberg . |
| 3,340,961 | 4/1966 | Provaznik . |
| 3,726,360 | 4/1973 | Price et al. . |
| 3,833,090 | 9/1974 | Georgianna . |

FOREIGN PATENT DOCUMENTS

| | | | |
|---|---|---|---|
| 560528 | 7/1958 | Canada . | |
| 689985 | 7/1964 | Canada . | |
| 1165349 | 4/1984 | Canada . | |
| 1483752 | 1/1966 | France . | |
| 313127 | 5/1956 | Switzerland . | |
| 167879 | 9/1991 | U.S.S.R. | 182/134 |

*Primary Examiner*—Alvin C. Chin-Shue

*Attorney, Agent, or Firm*—Jones, Tullar & Cooper

[57] ABSTRACT

A gripping device is provided for use with vertical or near vertical timbers on building sites, especially with 2"×4", 2"×6", or 2"×8" planks, and which allows such timbers to be used with a series of the devices forming steps of a temporary ladder. The timber may be leaning against a surface, or may be part of a scaffold or studs of a house. The device may be formed of a single piece of rod, or as a casting. It has a closed loop part suitable for use as a step, and also has a retaining part, the retaining part and loop having parallel portions defining an open sided recess for receiving the timber. At least one of the parallel portions has a set of teeth facing the other parallel portion, such that the device can be slid sideways on to a timber and can be pivoted down to cause the teeth to engage the timber and prevent further movement of the device.

9 Claims, 3 Drawing Sheets

GRIPPING DEVICE FOR TIMBER

This s a continuation-in-part of U.S. application Ser. No. 08/092,053, filed Jul. 15, 1993, abandoned.

FIELD OF THE INVENTION

The present invention provides a gripping device for use with generally vertical flat sided timbers, and is particularly useful on building sites to allow such timbers, either loose or incorporated in a building or in scaffolding, to be used as a kind of temporary ladder.

PRIOR ART

There are known gripping or climbing devices for timber, such as timber poles, which are attached to a workman's boots, for when he wants repeatedly to climb up poles, for example for electrical repair work. An example of such a device is shown in U.S. Pat. No. 3,726,360, which issued Apr. 10, 1973 to Price et. al. Such devices are however of little use on building sites, where a workman spends only a short proportion of his time climbing from one location to another, and would not want to strap devices as shown in this prior patent to his boots every time he wanted to climb to another level.

SUMMARY OF THE INVENTION

By contrast with known climbing devices of the type referred to above, the present invention provides a gripping device which does not attach to boots, etc., and which will normally remain in place on a vertical or near vertical timber, and is such that several of such devices placed one above the other can provide a series of steps and hand holds for workmen to move up or down from one level to the next. When work is finished at a particular site, the devices can easily be removed from the timbers and reused at another site. The devices can be used not only with vertical building studs or scaffolding timbers, but also with a loose piece of timber propped up against a surface as a ladder. The devices have uses other than for climbing, and for example may hold a pulley or rope to a timber.

In accordance with the invention, a gripping device for use with a generally vertical fiat-sided timber is largely formed from a single piece of material, the device including a closed loop part and a retaining part extending rearwardly of the closed loop part, the retaining part being formed by a rearwards extension of the closed loop part and lying in the same plane. The loop part is suitable for use as a step or hand hold in climbing the timber. The retaining part and the loop part have parallel portions defining an open sided recess for receiving the timber, and at least one of the parallel portions has a set of teeth facing the other parallel portion, the teeth being positioned so that a plane joining the teeth to the other parallel portion is angled relative to the plane occupied by the closed loop part. The device can be engaged with a timber by having the open-sided recess placed on the timber with the parallel portions on opposite sides of the timber, and by subsequent pivoting of the device downwards into a position in which the timber is gripped between the teeth and the other parallel portion.

The device may be formed from a single rod-like element or as a single, integrally cast piece of metal, such as steel. The rod-like element may be a bar or tube, but is preferably round steel rod having ribs, which is already available as reinforcing rod for concrete. This type of rod has ribs which are preferably exposed at least on a top side of the loop to provide a non-slip surface for the step. Alternatively, the device may be a casting with ribs cast in place. The step device otherwise has its top surface uninterrupted by protrusions, and in this sense is different from that of U.S. Pat. No. 3,726,360, in which the strap retaining members are in the form of protrusions which would make the device difficult for use as a step device.

Further in accordance with the invention, two of said sets of teeth are provided in a symmetrical arrangement both above and below the plane of the device, and such that the device can equally be used in a first orientation with its recess engaged on the one side of a timber, and can alternatively be used in inverted orientation with its recess engaged on the opposite side of the timber.

BRIEF DESCRIPTION OF THE DRAWINGS

The invention will further be described with reference to the preferred embodiment shown the accompanying drawings, in which.

DETAILED DESCRIPTION

Figure 3:
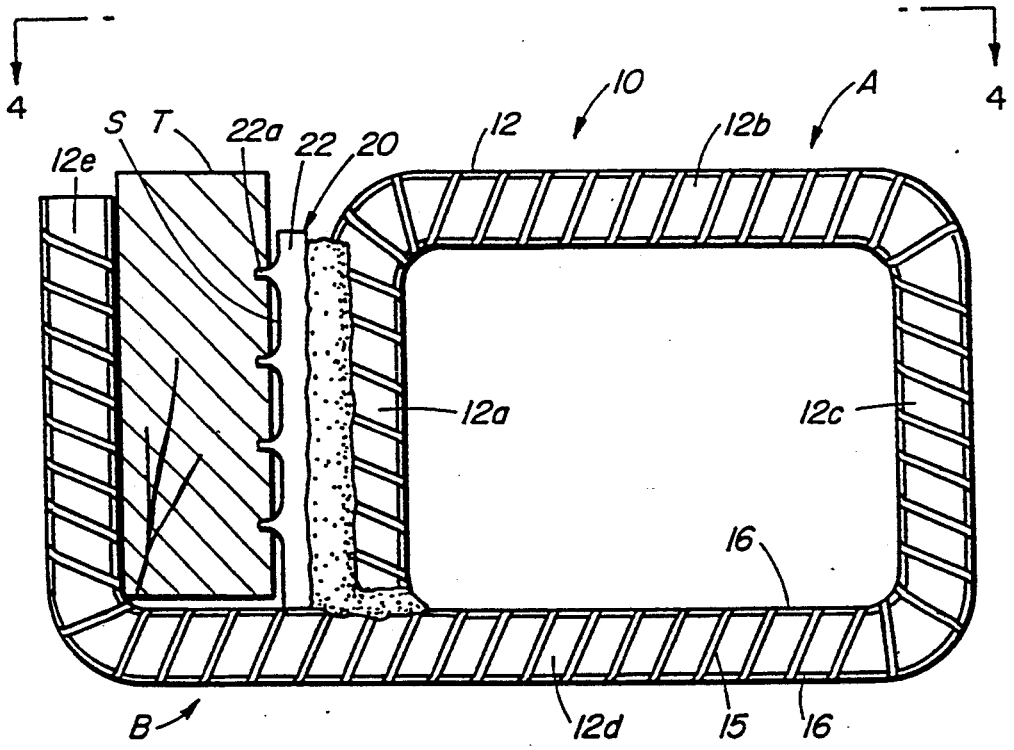
FIG. 3 shows a bottom view of one of the step devices, as seen on lines 3—3 of FIG. 1.
Figure 4:
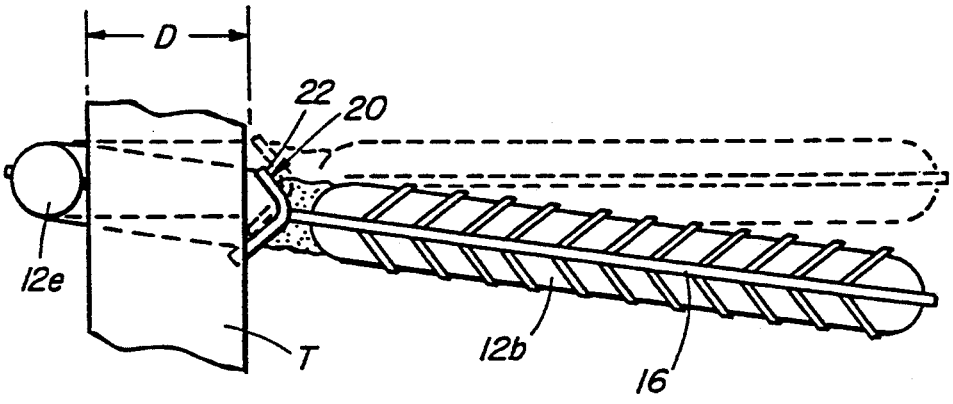
FIG. 4 shows an enlarged side view of the step device as shown on lines 4—4 of FIG. 3.

Referring to the drawings, especially FIGS. 3 and 4, the gripping device 10 is largely formed from a single length of steel rod 12, which is bent to form a substantially rectangular closed loop part A, at the front, and a retaining part B extending rearwardly of the loop part. The terms "front" and "rear" and similar terms are used herein with reference to how the device is viewed when in use, when part A projects towards a user. The shape of the formed rod part is similar to that of a right angled "6", and lies in a single plane. The loop part has a rear portion **12*a*, a first side portion 12*b*, a front portion 12*c*, a long second side portion 12*d* which is welded to the end of portion 12*a*, and extends beyond this and forms the retaining part together with a right angled end part 12*e*. Portions 12*a* and 12*e* are parallel, and together with the extension of side portion 12*d*** form opposite sides of a open-sided recess capable of receiving a timber T which is preferably 2"×4", 2"×6" or 2"×8" plank.

The steel rod 12 may be well known reinforcing rod (also known as rerod) used for concrete structures. For adequate rigidity, this should have a diameter of more than ½" and preferably about ⅝" or 15 mm. This type of rod is made with transverse ridges 15 which extend at an angle of about 60° to the axis of the rod between longitudinal ribs 16 on opposite sides of the rod. For this invention the rod is preferably bent so that the longitudinal ribs 16 are on the inside and outside of the loop, so that the ridges are fully exposed on the top and bottom of the loop to provide a non-slip surface when the device is used as a step. Preferably, the loop part is made large enough or small enough that it will not trap a worker's boot.

Figure 1:
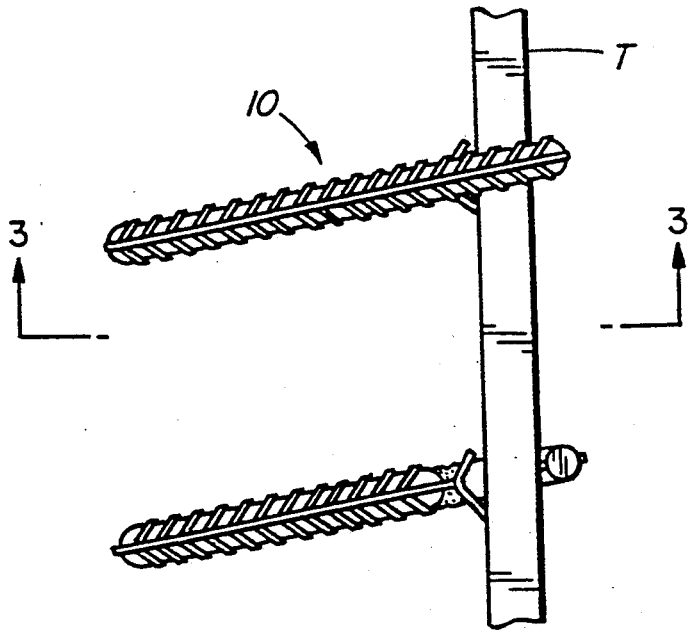
FIG. 1 shows a side view of two of the step devices attached to a vertical timber, for example as part of a scaffolding.
Figure 2:
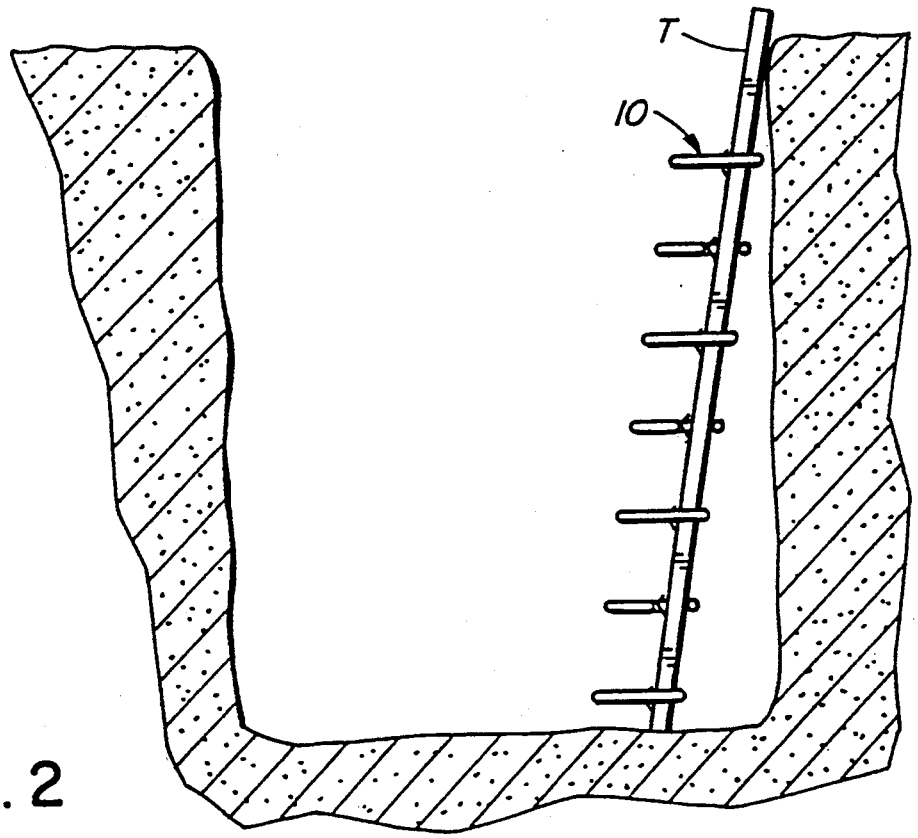
FIG. 2 shows a side view of a series of the step devices of this invention mounted on a timber plank to form a ladder allowing access to a deep pit.

The rear rod portion 12*a* carries a toothed angle member 20 securely welded to it, this member 20 having two mutually perpendicular flanges 22 extending at about 45° away from the central plane of part 12*a* towards the recess. Each flange 22 has a series of teeth 22*a* along its outer edge, capable of engagement with timber T inserted into the recess. As seen in FIG. 4, the dimension D between the ends of teeth 22*a* and the nearest surface of portion 12*e*, in the plane of the rod element, is about 1½" and is chosen to allow the device to slidingly engage with a timber T with little or no interference, when the plane of the step device is perpendicular to the timber. The device can then be pivoted down, as shown in full lines in FIG. 4, and in FIGS. 1 and 2, until the lower set of teeth firmly engage in the timber. On vertical timber the steps devices slope downwardly, but the ridges 15 provide a suitable non-slip surface for a workman's boot. The steps can be horizontal on a sloping piece of timber as shown in FIG. 2.

The toothed angled members 20 for these devices can be produced from flat plate steel, by cutting series of parallel rows of apertures the sides of which define the surfaces S between the teeth, and then separating strips from the plate by severing the narrow connecting parts which correspond to the outer ends of the teeth. This produces flat plates having teeth along opposite edges, which can then be bent at 90° along a centre line to produce the member 20.

It will be appreciated that a bundle of these devices can be taken by a workman to a building site, and applied to vertical or near vertical timbers, which may be building studs or scaffolding timbers, and the devices provide both steps and hand holds for easy climbing between floors. This is especially useful in house construction before installation of a staircase. The symmetrical nature of the devices, including the fact that both sides of the loop part are suitable for use as a step or hand hold, allows them to be used on either side, i.e. the left hand side or the right hand side, of a timber plank, and preferably the devices are installed alternately on opposite sides of the timber, as indicated in FIGS. 1 and 2. FIG. 2 shows a kind of ladder made by combining a series of the devices with a single piece of timber. The timber for such ladder is preferably fairly wide, e.g. 2"×8", to give reasonable stability in climbing.

In addition, the gripping devices can be used for other purposes when it is necessary to provide a securement of an element to a piece of timber. For example, the devices can be used to secure a pulley or the end of a rope to a vertical or horizontal timber.

Figure 5:
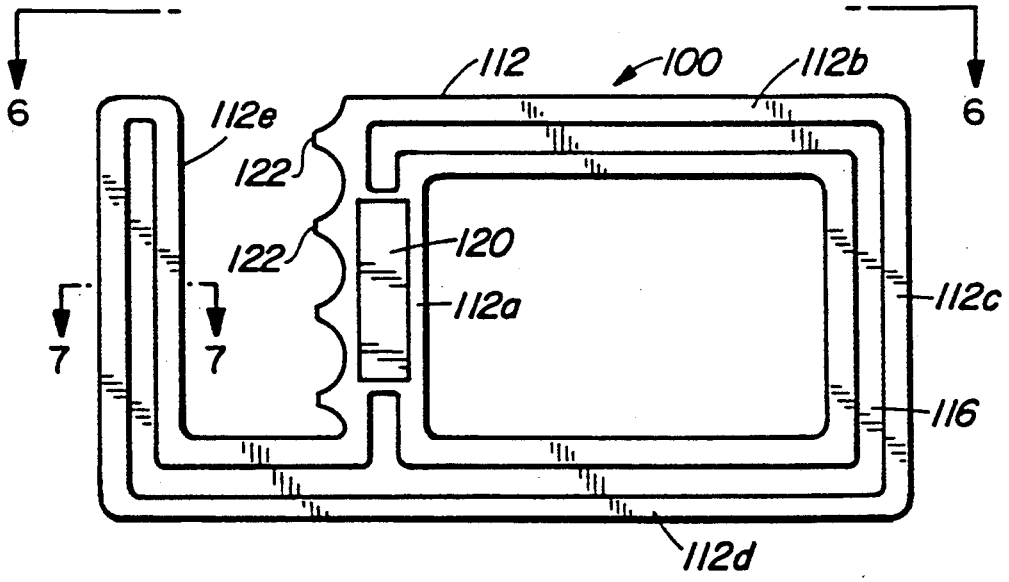
FIG. 5 shows a view similar to FIG. 3 of a modified form of the device, produced as a casting.
Figure 6:
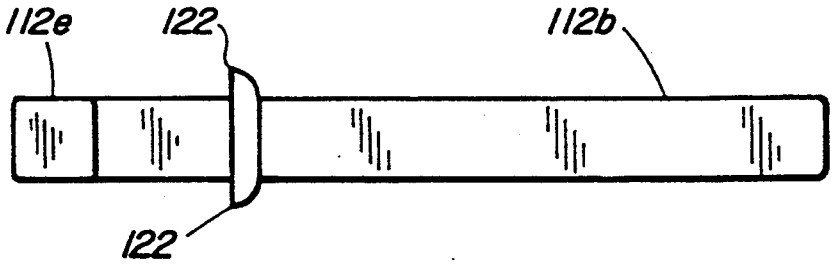
FIG. 6 shows a side elevation of the device of FIG. 5.
Figure 7:
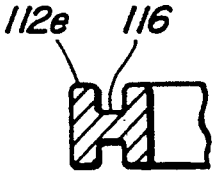
FIG. 7 is a cross-sectional view on lines 7—7 of FIG. 5.

FIGS. 5 to 7 show a modified form of the device which is integrally formed from steel, as a casting.

The basic form of the device is the same as that of the first embodiment, and includes a closed, essentially rectangular, loop part having a rear portion 112*a*, a first side portion 112*b*, a front portion 112*c*, a long second side portion 112*d* which is joined to the end of portion 1121, and which extends beyond this to form the retaining part together with right angled end part 112*e*. As before, portions 112*a* and 112*e* form sides of an open parallel sided recess for receiving a piece of timber.

The cross-sectional shape of parts 112*b*, 112*c*, 112*d*, and 112*e* is shown in FIG. 7. Each of these parts has flat inner and outer sides, and channels 116 in the upper and lower surfaces. This shape provides weight saving combined with adequate strength, and the ribs on each side of channel 116 provide an anti-slip feature. A central area of portion 112*a*, shown at 120, may be flattened to receive a trademark.

As in the first embodiment, portion 112*a* is provided with two rows of teeth 122 disposed above and below the plane of the device and which face inwardly of the recess between portions 112*a* and 112*e*. The teeth are provided by flat lands between U-shaped recesses cast into the inner side of portion 112*a*. These flat lands can co-operate with curved rear faces 122*a* of the teeth to provide sharp edges at the upper and lower extremities of the lands. For most purposes, sufficiently sharp teeth for engagement with timber can be produced merely by the casting process, but if desired these can be sharpened by machining the rear faces 122*a*. As in the first embodiment, the symmetrical arrangement of the rows of teeth above and below the plane of the device allows this to be used with either of its faces oriented upwardly for engagement with either a left or a right side of a timber.

I claim:

1. A gripping device for use with a generally vertical flat-sided timber, said device being largely formed from a single piece of rod-like element;

wherein said rod-like element includes a closed loop part and a retaining part extending rearwardly of the closed loop part, said retaining part being formed by a rearwards extension of the closed loop part and lying in the same plane as said loop part, said loop part having its opposite sides both suitable for use as a step or hand hold for climbing the timber;

said retaining part and loop part having parallel portions defining an open-sided recess for receiving the timber, one of said parallel portions having two sets of teeth facing the other parallel portion, each of said sets of teeth being positioned so that a plane joining the teeth to said other parallel portion is angled relative to the plane occupied by the loop part and retaining parts;

whereby said device can be engaged with the timber by having the open-sided recess placed on the timber with said parallel portions on opposite flat sides of the timber, and by subsequent pivoting of the device relative to the timber into a position in which the timber is gripped between the teeth of one of said sets and said other parallel portion, and wherein said two sets of teeth are provided in a symmetrical arrangement both above and below said plane, and such that the device can equally be used in a first orientation with the recess engaged on one side of a timber and can alternatively be used in inverted orientation with its recess engaged on the opposite side of the timber; downwards pivoting on the loop part tending to urge the lower of said sets of teeth into the timber.

2. A device according to claim 1, wherein said rod-like element is steel reinforcing rod characterized by ridge elements which are exposed on at least a top side of said loop part to provide a non-slip surface for said device; said device having its top surface otherwise uninterrupted by protrusions.

3. A device according to claim 1, wherein said sets of teeth are formed on opposite edges of an angle member welded to said one parallel portion, said one parallel portion being a rear side of said loop part.

4. A device according to claim 1, wherein said closed loop part is essentially rectangular.

5. A temporary ladder comprising a flat-sided timber and a series of devices according to claim 1, said devices being engaged with the timber and spaced apart to form a series of steps and hand holds capable of being used for climbing the timber.

6. A gripping device for use with a generally vertical flat-sided timber, said device being integrally formed from a single piece of material;

wherein said device includes a closed loop part and a retaining part extending rearwardly of the closed loop part, said retaining part being formed by a rearwards extension of the closed loop part and lying in the same plane, said loop part having its opposite sides both suitable for use as a step or hand hold for climbing the timber;

said retaining part and loop part having parallel portions defining an open-sided recess for receiving the timber, one of said parallel portions having two rows of teeth facing the other parallel portion, said rows of teeth being positioned in a symmetrical arrangement both above and below said same plane, and so that planes joining the teeth to said other parallel portion are angled relative to said same plane;

whereby said device can be engaged with the timber by having the open-sided recess placed on the timber with said parallel portions on opposite flat sides of the timber, and by subsequent pivoting of the device relative to the timber into a position in which the timber is gripped between one row of said teeth and said other parallel portion, said two rows of teeth allowing the device to be used with the recess engaged on one side of a timber and alternatively to be used in inverted orientation with its recess engaged on the other side of the timber, downwards pivoting of the loop part tending to urge the lower of said rows of teeth into the timber.

7. A device according to claim 6, which is integrally formed as a steel casting.

8. A device according to claim 6, wherein said closed loop part is essentially rectangular.

9. A temporary ladder comprising a flat-sided timber and a series of devices according to claim 6, said devices being engaged with the timber and spaced apart to form a series of steps and have holds capable of being used for climbing the timber.

* * * * *